US011313114B2

(12) United States Patent
Krohlow

(10) Patent No.: US 11,313,114 B2
(45) Date of Patent: Apr. 26, 2022

(54) DRAIN CLEANER

(71) Applicant: MILWAUKEE ELECTRIC TOOL CORPORATION, Brookfield, WI (US)

(72) Inventor: Samuel J. Krohlow, Wauwatosa, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 300 days.

(21) Appl. No.: 16/567,012

(22) Filed: Sep. 11, 2019

(65) Prior Publication Data

US 2020/0080293 A1 Mar. 12, 2020

Related U.S. Application Data

(60) Provisional application No. 62/729,526, filed on Sep. 11, 2018.

(51) Int. Cl.
*E03C 1/302* (2006.01)
*E03F 9/00* (2006.01)
(Continued)

(52) U.S. Cl.
CPC ..... *E03C 1/302* (2013.01); *B08B 9/043* (2013.01); *B08B 9/045* (2013.01); *B08B 9/0436* (2013.01); *E03F 9/005* (2013.01)

(58) Field of Classification Search
CPC ..... B08B 9/04; B08B 9/043; B08B 9/0436; B08B 9/045; E03C 1/302; E03F 9/002; E03F 9/005
(Continued)

(56) References Cited

U.S. PATENT DOCUMENTS 2,355,733 A 8/1944 Johnson et al.
2,661,489 A * 12/1953 Rudolph ..... E03F 9/005 15/104.33
(Continued)

FOREIGN PATENT DOCUMENTS

CN 2464800 Y 12/2004
CN 203049728 U 7/2013
(Continued)

OTHER PUBLICATIONS

European Search Report for Application No. 17183628.1 dated Dec. 8, 2017 (15 pages).
(Continued)

*Primary Examiner* — Mark Spisich
(74) *Attorney, Agent, or Firm* — Michael Best & Friedrich LLP

(57) ABSTRACT

A drain cleaner includes a drum assembly configured to store a cable and an actuator assembly movable relative to the drum assembly between a neutral position, where the cable is free to spin and translate out of the drum assembly, an autofeed position, where the cable is allowed to spin and is automatically driven out of the drum assembly, and an autofeed locked on position, where the actuator assembly is maintained in the autofeed position without continuous input from a user. The actuator assembly includes a handle supported by the drum assembly and an autofeed locking mechanism. The autofeed locking mechanism includes a drive lock and a lock release. The drive lock engages the handle to maintain the actuator assembly in the autofeed locked on position.

12 Claims, 10 Drawing Sheets

(51) Int. Cl.
*B08B 9/043* (2006.01)
*B08B 9/045* (2006.01)

(58) Field of Classification Search
USPC ..... 15/104.33
See application file for complete search history.

(56) References Cited

U.S. PATENT DOCUMENTS

| | | | | |
|---|---|---|---|---|
| 2,769,191 | A * | 11/1956 | Hunt | E03F 9/005 15/104.33 |
| 2,930,584 | A | 3/1960 | Hensley et al. | |
| 3,025,547 | A | 3/1962 | Ciaccio | |
| 3,075,217 | A | 1/1963 | Kollmann | |
| 3,159,861 | A | 12/1964 | Sarcone | |
| 3,206,782 | A | 9/1965 | Larsen | |
| 3,224,024 | A * | 12/1965 | Hunt | E03F 9/005 15/104.33 |
| 3,246,354 | A | 4/1966 | Cooney et al. | |
| 3,414,926 | A | 12/1968 | Bloom | |
| 3,449,782 | A | 6/1969 | Hunt | |
| 3,544,051 | A | 12/1970 | Norman | |
| 3,691,583 | A | 9/1972 | Silverman et al. | |
| 3,727,261 | A | 4/1973 | Levine | |
| 3,882,565 | A | 5/1975 | Irwin et al. | |
| 3,928,885 | A | 12/1975 | Peterson et al. | |
| 4,218,802 | A | 8/1980 | Babb et al. | |
| 4,356,557 | A | 10/1982 | Bell et al. | |
| 4,364,139 | A | 12/1982 | Babb et al. | |
| 4,395,791 | A | 8/1983 | Irwin | |
| 4,540,017 | A | 9/1985 | Prange | |
| 4,580,306 | A | 4/1986 | Irwin | |
| 4,686,732 | A | 8/1987 | Irwin | |
| 4,793,017 | A | 12/1988 | Kaye | |
| 4,916,772 | A | 4/1990 | Russell et al. | |
| 4,956,889 | A | 9/1990 | Kirk | |
| 4,989,323 | A | 2/1991 | Casper et al. | |
| 5,009,242 | A | 4/1991 | Prange | |
| 5,029,356 | A | 7/1991 | Silverman et al. | |
| 5,031,263 | A | 7/1991 | Babb et al. | |
| 5,031,276 | A | 7/1991 | Babb et al. | |
| 5,414,888 | A | 5/1995 | Irwin | |
| 5,526,975 | A | 6/1996 | Endo | |
| 5,640,736 | A | 6/1997 | Salecker | |
| 5,901,401 | A | 5/1999 | Rutkowski et al. | |
| 6,076,219 | A | 6/2000 | Irwin | |
| 6,158,076 | A * | 12/2000 | Rutkowski | E03F 9/005 15/104.31 |
| 6,343,398 | B1 | 2/2002 | Silverman et al. | |
| 6,360,397 | B1 | 3/2002 | Babb | |
| 6,412,136 | B1 | 7/2002 | Rutkowski | |
| 6,470,525 | B1 | 10/2002 | Silverman | |
| 6,615,436 | B1 | 9/2003 | Burch, Jr. et al. | |
| 6,637,064 | B2 | 10/2003 | Silverman et al. | |
| 6,655,228 | B1 | 12/2003 | Margherio et al. | |
| 6,745,487 | B1 | 6/2004 | Nield | |
| 7,007,399 | B2 | 3/2006 | Catalano | |
| 7,478,451 | B2 | 1/2009 | Rutkowski et al. | |
| 7,676,879 | B1 | 3/2010 | Rutenberg et al. | |
| 7,685,669 | B2 | 3/2010 | Rutkowski et al. | |
| 7,889,980 | B2 | 2/2011 | Sooy | |
| 8,046,862 | B2 | 11/2011 | Eisermann et al. | |
| 8,176,593 | B2 | 5/2012 | Gress et al. | |
| 8,413,347 | B2 | 4/2013 | Gress et al. | |
| 8,826,483 | B2 | 9/2014 | Rutkowski et al. | |
| 8,970,211 | B1 | 3/2015 | Olsson et al. | |
| 9,041,794 | B1 | 5/2015 | Olsson et al. | |
| 10,071,401 | B2 | 9/2018 | Dunkin et al. | |
| 2005/0193509 | A1 | 9/2005 | Rutkowski et al. | |
| 2007/0089254 | A1 | 4/2007 | Alaine | |
| 2008/0148503 | A1 | 6/2008 | Babb et al. | |
| 2008/0244816 | A1 | 10/2008 | Babb et al. | |
| 2008/0313831 | A1 | 12/2008 | Kovach et al. | |
| 2009/0211044 | A1 | 8/2009 | Hale et al. | |
| 2013/0160227 | A1 | 6/2013 | Rutkowski et al. | |
| 2014/0202492 | A1 | 7/2014 | Grossman et al. | |
| 2017/0284078 | A1 | 10/2017 | Puzio et al. | |
| 2018/0030714 | A1 | 2/2018 | Miller et al. | |
| 2018/0030715 | A1 | 2/2018 | Miller et al. | |

FOREIGN PATENT DOCUMENTS

| | | | |
|---|---|---|---|
| CN | 203270721 | U | 11/2013 |
| CN | 203346973 | U | 12/2013 |
| CN | 104120767 | A | 10/2014 |
| CN | 204482269 | | 7/2015 |
| CN | 204482269 | U | 7/2015 |
| DE | 3423464 | | 1/1986 |
| DE | 10248411 | | 4/2004 |
| EP | 0683279 | | 11/1995 |
| EP | 3276097 | * | 1/2018 |
| WO | WO 2006112848 | | 10/2006 |
| WO | WO 2007008885 | | 1/2007 |
| WO | WO 2008124230 | | 10/2008 |
| WO | WO 2009143497 | | 11/2009 |
| WO | WO 2016106110 | | 6/2016 |
| WO | 2017/100653 | * | 6/2017 |

OTHER PUBLICATIONS

European Search Report for Application No. 17183622.4 dated Dec. 8, 2017 (10 pages).
European Search Report for Application No. 17183628.1 dated Jun. 28, 2018, 14 pages.
International Search Report and Written Opinion for Application No. PCT/2019/012509 dated Apr. 23, 2019, 15 pages.
Chinese Patent Office Action for Application No. 201710625562.9 dated May 7, 2019, with English translation, 11 pages.
International Search Report and Written Opinion For Application No. PCT/US2019/050503 dated Jan. 3, 2020 (9 pages).

* cited by examiner

DRAIN CLEANER

CROSS REFERENCE TO RELATED APPLICATIONS

This application claims priority to U.S. Provisional Patent Application No. 62/729,526, filed Sep. 11, 2018, the entire contents of which are incorporated herein by reference.

BACKGROUND

The present invention relates to drain cleaners.

Typically, drain cleaners include a drum that stores a drain cleaning cable. When the drum is rotated (e.g., via a motor or manually by a handle), friction between an inner surface of the drum and the cable causes the cable to spin to facilitate clearing debris from a drain. The cable can be pulled out of the drum and directed into a drain either manually (e.g., a user grabs the cable and pulls) or with a secondary device (e.g., a cable feed mechanism that selectively engages the cable to drive the cable out).

SUMMARY

In one embodiment, the invention provides a drain cleaner including a drum assembly configured to store a cable and an actuator assembly movable relative to the drum assembly between a neutral position, where the cable is free to spin and translate out of the drum assembly, an autofeed position, where the cable is allowed to spin and is automatically driven out of the drum assembly, and an autofeed locked on position, where the actuator assembly is maintained in the autofeed position without continuous input from a user. The actuator assembly includes a handle supported by the drum assembly and an autofeed locking mechanism. The autofeed locking mechanism includes a drive lock and a lock release. The drive lock engages the handle to maintain the actuator assembly in the autofeed locked on position.

In another embodiment, the invention provides a drain cleaner configured to support a cable and feed the cable into a drain. The drain cleaner includes an actuator assembly movable between a neutral position, where the cable is free to spin and translate, an autofeed position, where the cable is allowed to spin and is automatically driven out of or into the drain cleaner, and a locked position, where the cable is able to spin, but not allowed to travel out of or into the drain cleaner. The actuator assembly includes a handle, an autofeed locking mechanism, and a cable locking mechanism. The autofeed locking mechanism includes a drive lock and a lock release. The drive lock engages the handle to maintain the actuator assembly in the autofeed position.

In another embodiment, the invention provides a drain cleaner including a drum assembly configured to store a cable. The drum assembly includes a nose with a first portion and a second portion. The drain cleaner also includes an actuator assembly movable relative to the drum. The actuator assembly includes a handle supported by the nose of the drum assembly. The handle includes an inlet, an outlet opposite the inlet, a passage extending between the inlet and the outlet, and an abutment on an inside surface of the passage. The actuator assembly also includes an autofeed locking mechanism positioned within the handle. The autofeed locking mechanism includes a drive lock positioned on the second portion of the nose and a lock release positioned on the second portion of the nose. The actuator assembly is moveable between a neutral position, where the cable is free to spin and translate out of the drum assembly, an autofeed position, where the cable is allowed to spin and is automatically driven out of or into the drum assembly, and a locked position, where the cable is able to spin, but not allowed to travel out of or into the drain cleaner. The drive lock engages the abutment of the handle to maintain the actuator assembly in the autofeed position.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
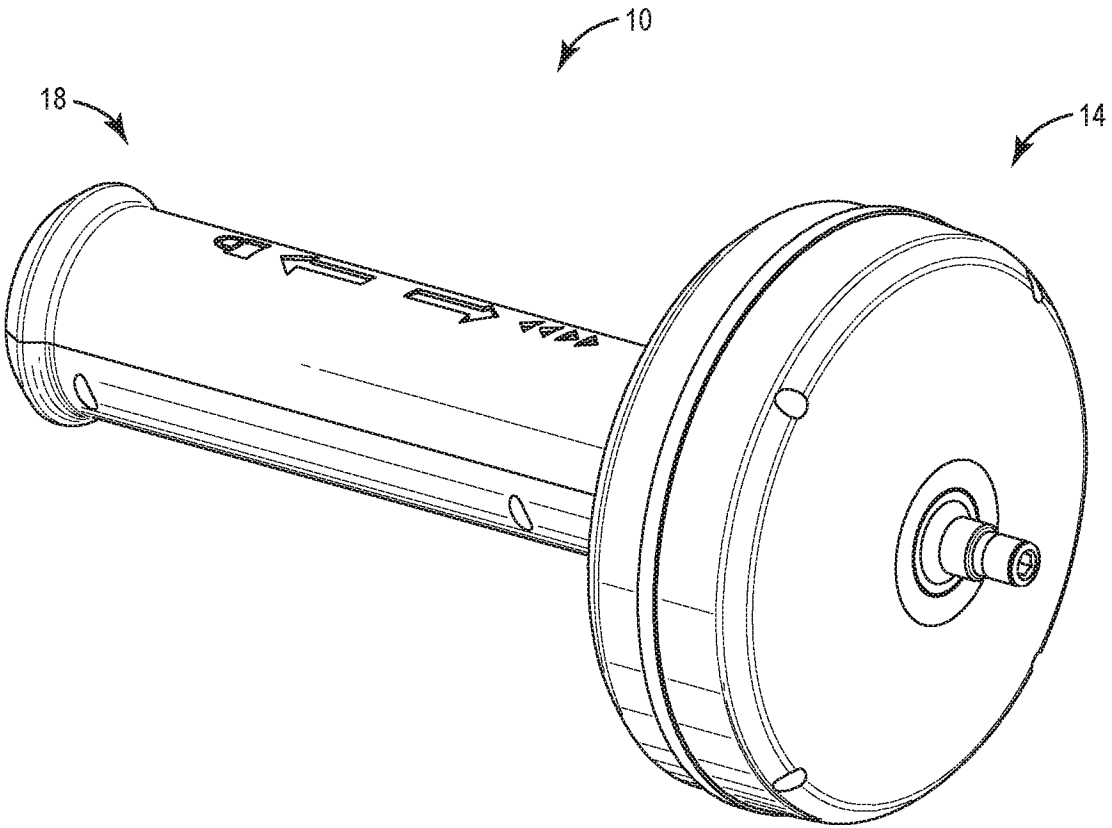
FIG. 1 is a perspective view of a portion of a drain cleaner.

FIG. 1 illustrates part of a drain cleaner 10. The drain cleaner 10 is configured to extend a drain cleaning cable, or spring or snake, (not shown) into a drain or other conduit to clear debris within the drain or conduit. The drain cleaner 10 may be a relatively compact, hand-held auger style drain cleaner or may be a relatively large sewer cleaning machine. The illustrated drain cleaner 10 includes a drum assembly 14 and an actuator assembly 18. The drum assembly 14 and the actuator assembly 18 may be supported by a handle assembly that allows a user to grasp and carry the drain cleaner. Alternatively, the drum assembly 14 and the actuator assembly 18 may be supported by a frame that allows a user to move the drain cleaner 10 along the ground (e.g., via wheels, tracks, etc.). The drain cleaner 10 may also include a motor and a drive mechanism coupled to the drum assembly 14 to rotate the drum assembly 14. The motor may be energized by a power source, such as a DC power tool battery pack or an AC power source.

Figure 2:
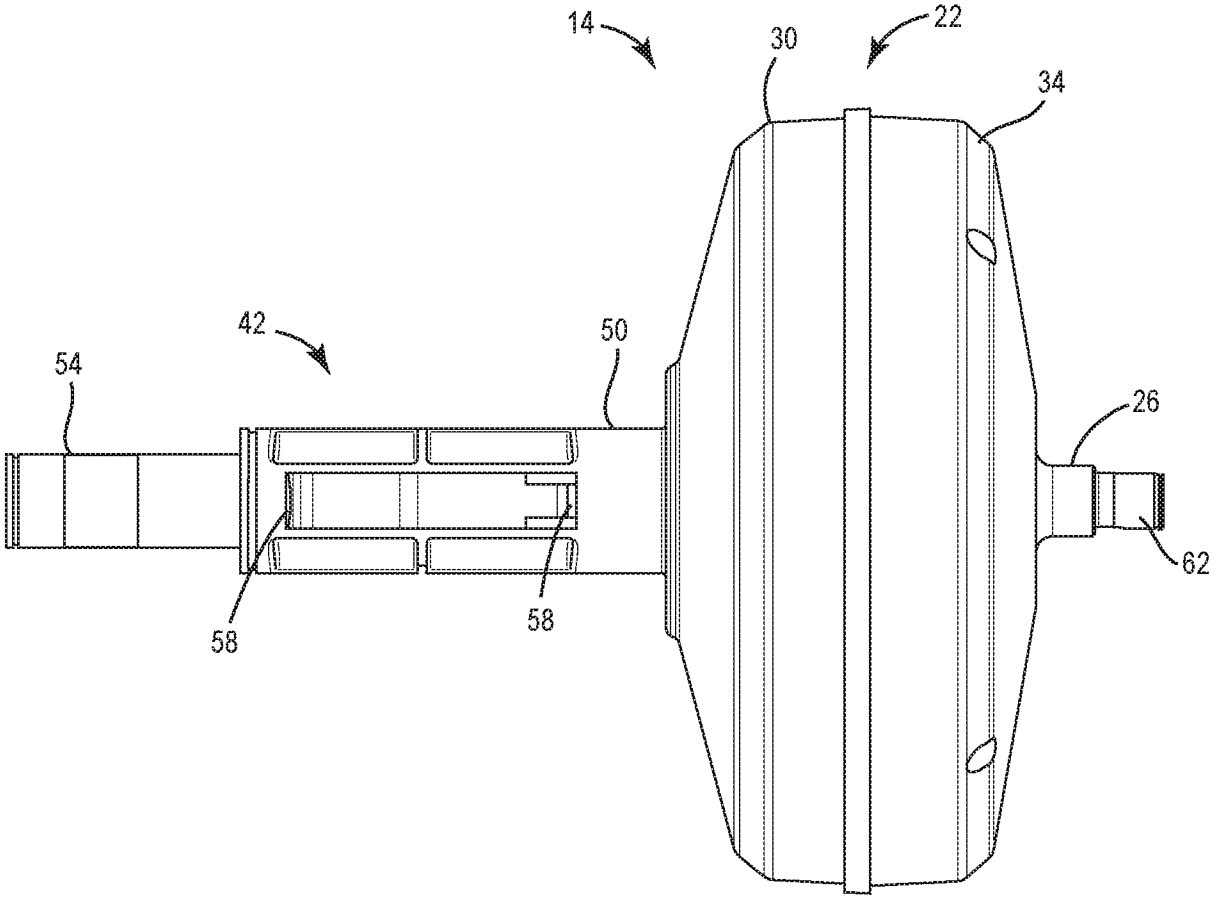
FIG. 2 is a side view of a drum of the drain cleaner of FIG. 1.
Figure 3:
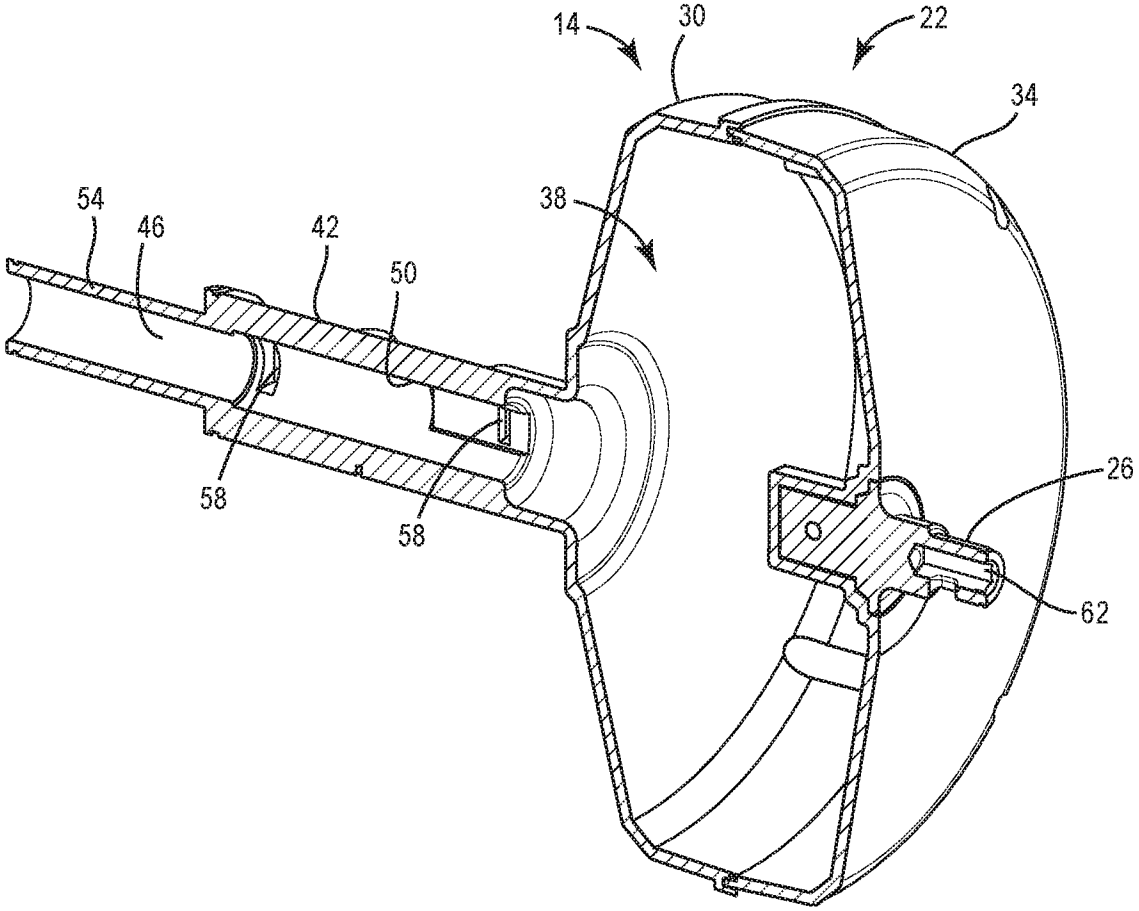
FIG. 3 is a cross-sectional view of the drum of FIG. 2.

Now referring to FIGS. 2 and 3, the drum assembly 14 includes a drum or housing 22 and an adapter 26. The housing 22 is configured to store the flexible cable that extends out of the drain cleaner 10. Rotation of the drum assembly 14 creates friction between an inner surface of the housing 22 and the cable, causing the cable to spin which facilitates clearing debris from a drain. In another embodiment, one end of the cable is fixed to the drum 22 and rotation of the drum 22 causes the cable to spin (i.e., rather than relying on friction). The housing 22 includes a front housing portion 30, a rear housing portion 34, and an interior 38 (FIG. 3) therebetween. In the illustrated embodiment, the rear housing portion 34 is removable from the front housing portion 30 to gain access to the interior 38. For example, the rear housing portion 34 may detach from the front housing portion 30 to install or replace the flexible cable stored within. In other embodiments, the housing 22 may be formed as a single integral piece. The front housing portion 30 includes a nose 42 that defines an interior passageway 46 (FIG. 3) through which the cable extends. The nose 42 includes a first portion 50 and a second portion 54. The first portion 50 of the nose 42 has a larger diameter than the second portion 54 and includes openings 58 that communicate with the interior passageway 46.

The illustrated adapter 26 is coupled to the rear housing portion 34 and extends into the interior 38. The adapter 26 is configured for co-rotation with the drum assembly 14. The adapter 26 includes a coupling 62 that is configured to receive a tool that rotates the drum assembly 14. In the illustrated embodiment, the coupling 62 is a ¼" hex quick connect. In other embodiments, the coupling 62 may be other sizes or other types of couplings. The coupling 62 may connect to a handle for manual rotation of the drum assembly 14. Alternatively, the coupling may connect to a powered drive mechanism (e.g., a mechanism driven by a motor and a power source) for automatic rotation of the drum assembly 14.

Figure 4:
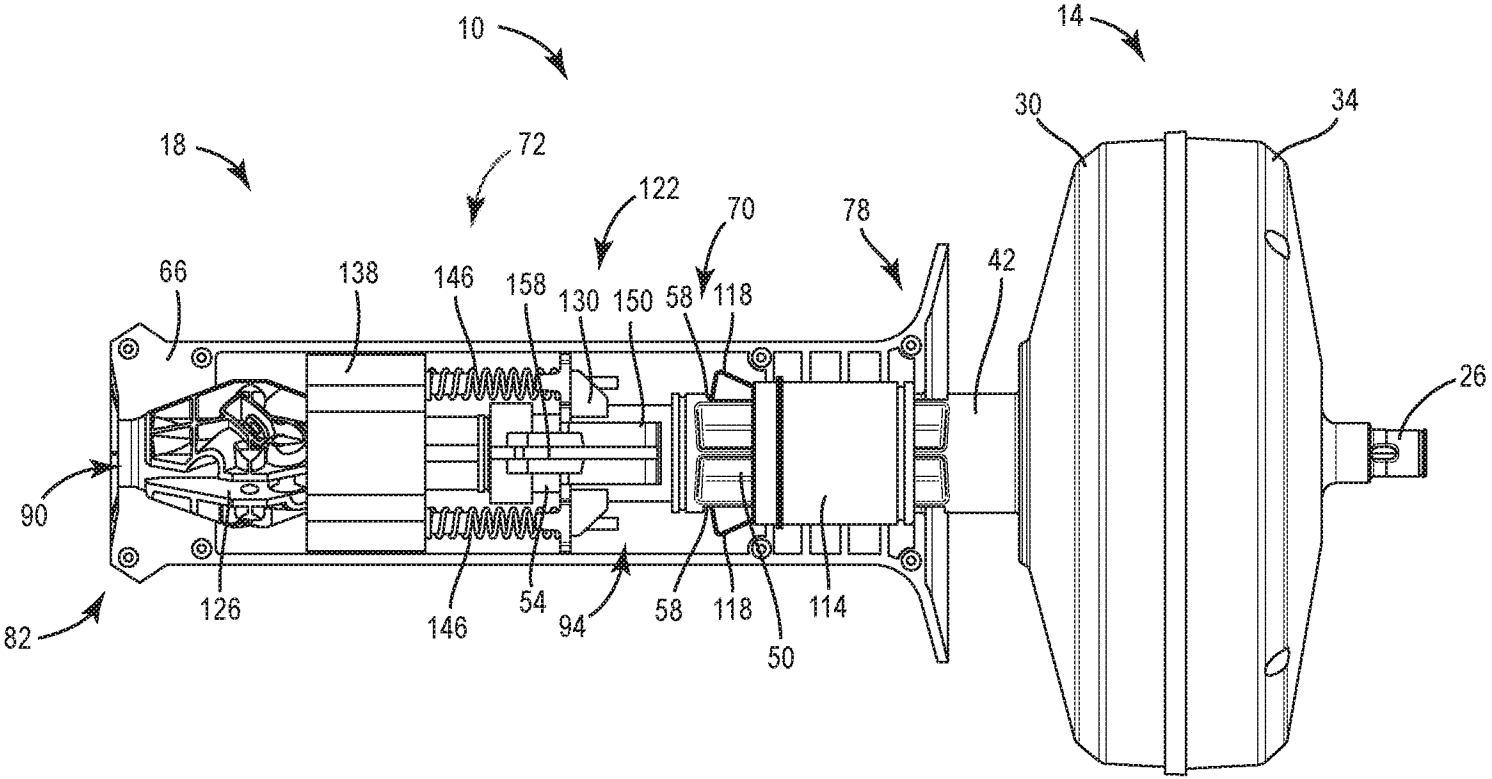
FIG. 4 is a perspective view of the drain cleaner of FIG. 1 with a portion of a handle removed.
Figure 5:
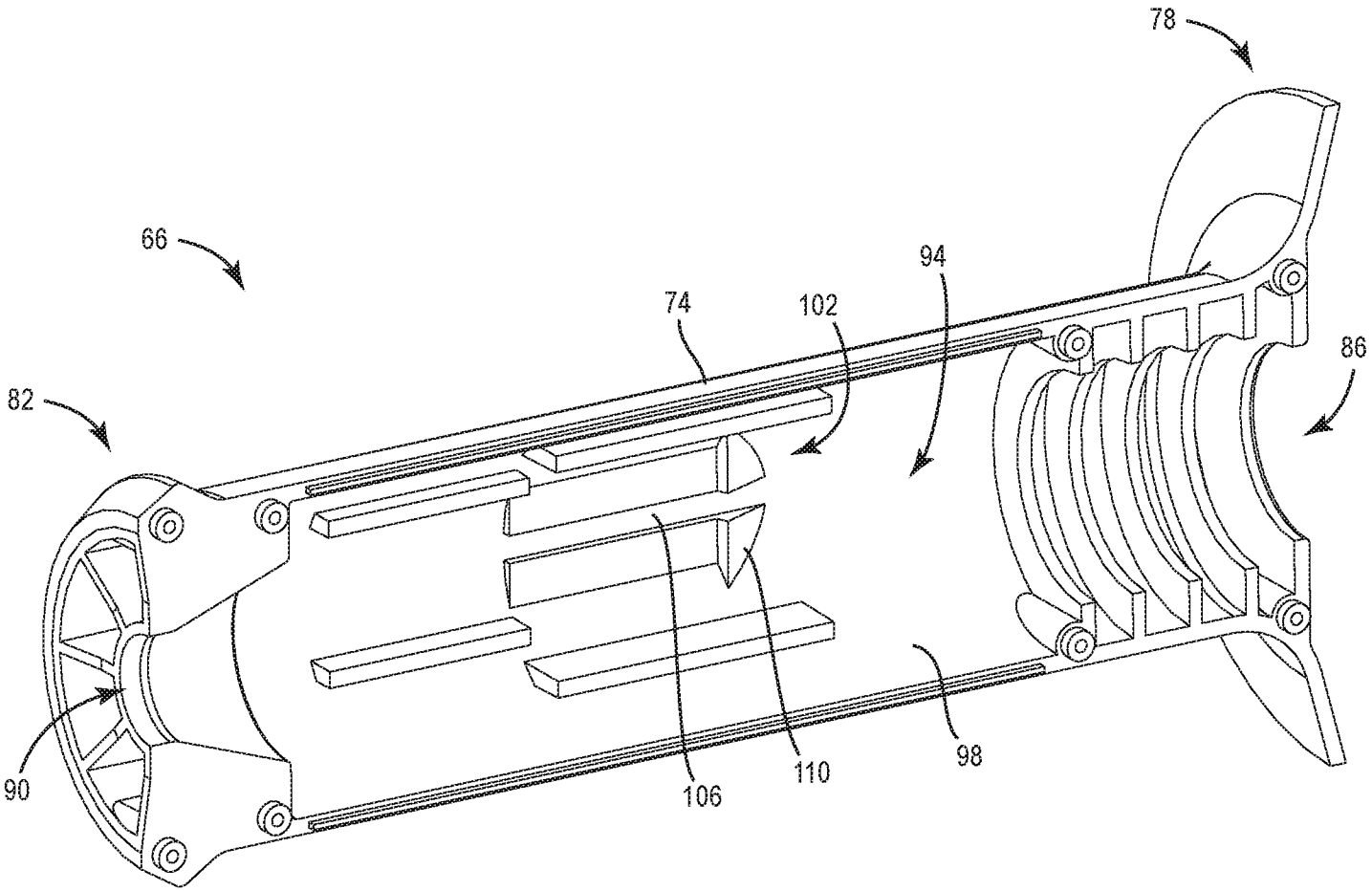
FIG. 5 is cross-sectional view of the handle of the drain cleaner of FIG. 1.

With reference to FIG. 4, the actuator assembly 18 is movably coupled to the drum assembly 14. Specifically, the actuator assembly 18 is translatable on the nose 42 of the front housing portion 30. The actuator assembly 18 includes a handle 66, a cable locking mechanism 70, and an autofeed locking mechanism 72. Now moving to FIG. 5, the handle 66 includes a grip 74 that a user may grasp to hold the drain cleaner 10, a rear end 78 adjacent the drum assembly 14, a front end 82 opposite the rear end 78, an inlet 86 formed at the rear end 78, and an outlet 90 formed at the front end 82. A passage 94 is defined in the handle 66 and extends from the inlet 86 to the outlet 90. The cable locking mechanism 70 and the autofeed locking mechanism 72 (FIG. 4) are supported within the passage 94 of the handle 66. The passage 94 is defined by an interior surface 98 with locking ramps 102. Although only one locking ramp 102 is illustrated in FIG. 5, the handle 66 includes an additional locking ramp 102 on an opposite side of the interior surface 98. Each locking ramp 102 defines a slot 106 and an abutment 110.

Referring back to FIG. 4, the cable locking mechanism 70 includes an actuator sleeve 114 and cable clamps 118. The actuator sleeve 114 is positioned in the passage 94 of the handle 66 adjacent the rear end 78 for translation with the handle 66 relative to the drum assembly 14. In particular, the actuator sleeve 114 is translatable on the first portion 50 of the nose 42. The cable clamps 118 are secured to the first portion 50 of the front housing portion 30 at one end and partially extend over the openings 58 (FIG. 3) at another end. The cable clamps 118 are resilient and are biased away from the openings 58. The cable clamps 118 selectively engage the flexible cable to inhibit the flexible cable from translating further out of the drain cleaner 10. In other words, the cable is able to spin, but not allowed to travel out of or into the drain cleaner 10. In the illustrated embodiment, the cable clamps 118 are spring clips. In other embodiments, the cable clamps 118 may be other types of clamps and/or may be other types of resilient members.

Figure 9:
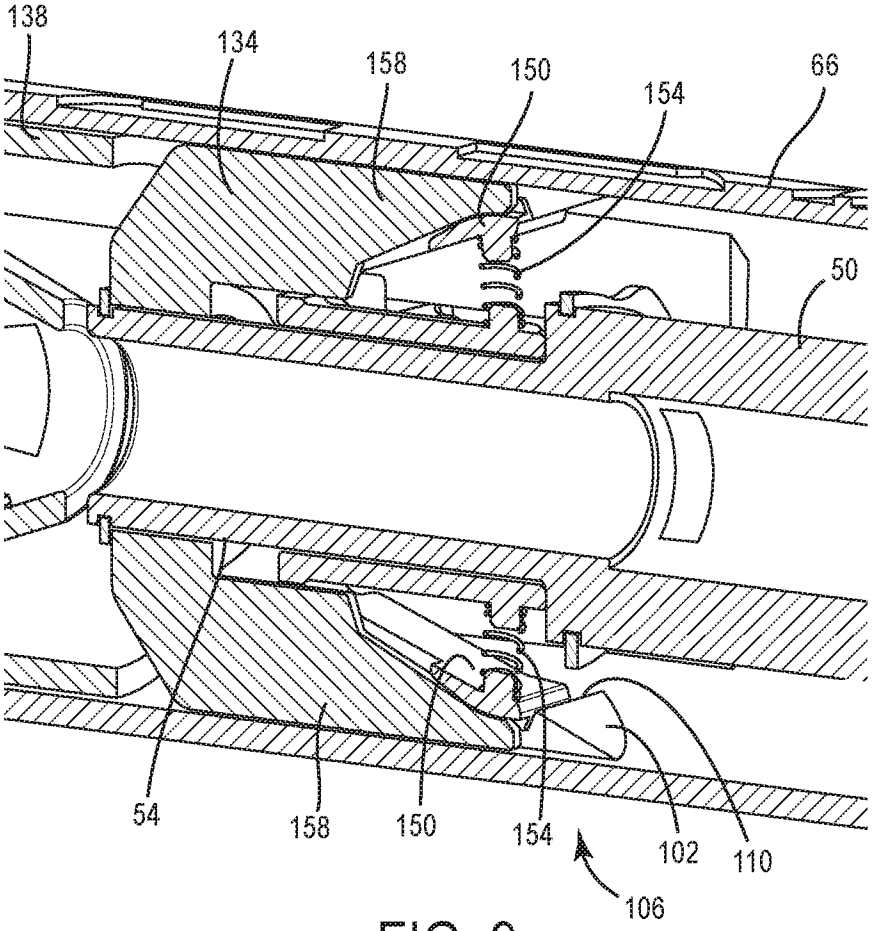
FIG. 9 is an enlarged cross-sectional view of a drive lock ratchet mechanism of the drain cleaner of FIG. 8.
Figure 10:
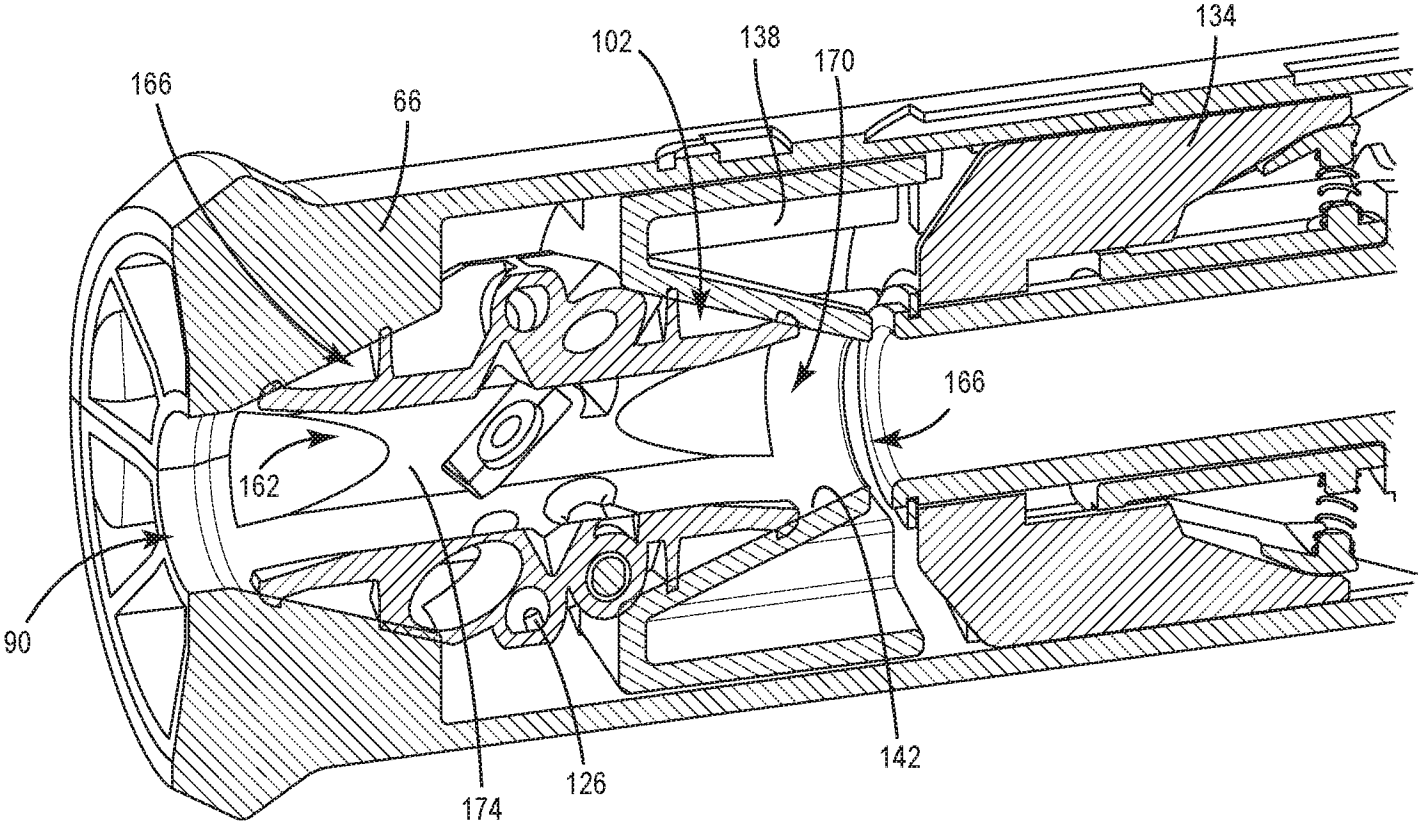
FIG. 10 is an enlarged cross-sectional view of a collet of the drain cleaner of FIG. 8.

The autofeed locking mechanism 72 includes a drive lock ratchet mechanism 122 and a collet 126. The drive lock ratchet mechanism 122 includes a drive lock 130, a lock release 134 (FIGS. 6-7), and a drive ramp 138. The drive ramp 138 defines a frustoconically-shaped opening 142 (FIG. 10). Both the drive lock 130 and the lock release 134 are positioned over the second portion 54 of the nose 42 and are movable relative to the housing 22 of the drum assembly 14. The drive ramp 138 is biased towards the front end 82 of the handle 66 and away from the drive lock 130 by resilient members (e.g., compression springs 146). The drive lock 130 includes wings 150 that are positioned on diametrically opposite sides from each other. The wings 150 are biased radially outward by resilient members (e.g., compression springs 154 (FIG. 9)). The lock release 134 includes disengagement tabs 158 that selectively engage the wings 150 of the drive lock 130. The disengagement tabs 158 are a similar size as the slots 106 in the locking ramps 102 so as to be able to pass through the slots 106 when the lock release 134 translates.

With reference to FIG. 10, the collet 126 is double frustoconically shaped. In other words, the collet 126 includes a first end 162 that is frustoconically-shaped and a second end 166 opposite the first end 162 that is also frustoconically-shaped. The first end 162 of the collet 126 corresponds to the frustoconically-shaped opening 142 of the drive ramp 138, and the second end 166 of the collet 126 is positioned within the outlet 90 of the handle 66. The illustrated collet 126 includes a plurality of pieces with a similar shape that are all connected to each other. In the illustrated embodiment, the collet 126 is made of three pieces. In other embodiments, the collet 126 may be made of more or fewer pieces. The pieces of the collet 126 together define an aperture 170 through which the flexible cable extends. The aperture 170 is defined by inner surfaces 174 of each collect piece. Each piece of the collet 126 also supports a roller or bearing that selectively engages the cable. The pieces of the collet 126 are compressible to reduce the space within the aperture 170. When the collet 126 is compressed, the rollers engage the flexible cable to drive the flexible cable out of or into the outlet 90 of the handle 66.

In operation of the drain cleaner 10, a user attaches a drive tool (e.g., a handle or a powered drive mechanism) to the adapter 26 of the drum assembly 14. The drive tool rotates the drum assembly 14 to create friction between the interior 38 of the housing 22 and the cable. The friction causes the flexible cable to spin, which facilitates clearing debris from within a drain or conduit. While the drum assembly 14 is rotated, the actuator assembly 18 remains stationary. The cable extends from the interior 38 of the housing 22 through the interior passageway 46 of the front housing portion 30 through the passage 94 of the handle 66 and out the outlet 90. The cable may then be directed into a drain or other conduit.

The illustrated actuator assembly 18, cable locking mechanism 70, and autofeed locking mechanism 72 are selectively movable relative to the drum assembly 14 to control the output of the flexible cable. Specifically, the actuator assembly 18 is movable between a first position (FIG. 6), a second position (FIG. 7), and a third position (FIG. 8). The first position is a neutral position, where the cable is free to spin and translate out of the drain cleaner 10. The second position is a locked position, where the cable is allowed to spin, but not to translate into or out of the drum assembly 14. The third position is an autofeed position, where the cable is allowed to spin and is automatically driven (e.g., translated) out of the drum assembly 14.

Figure 6:
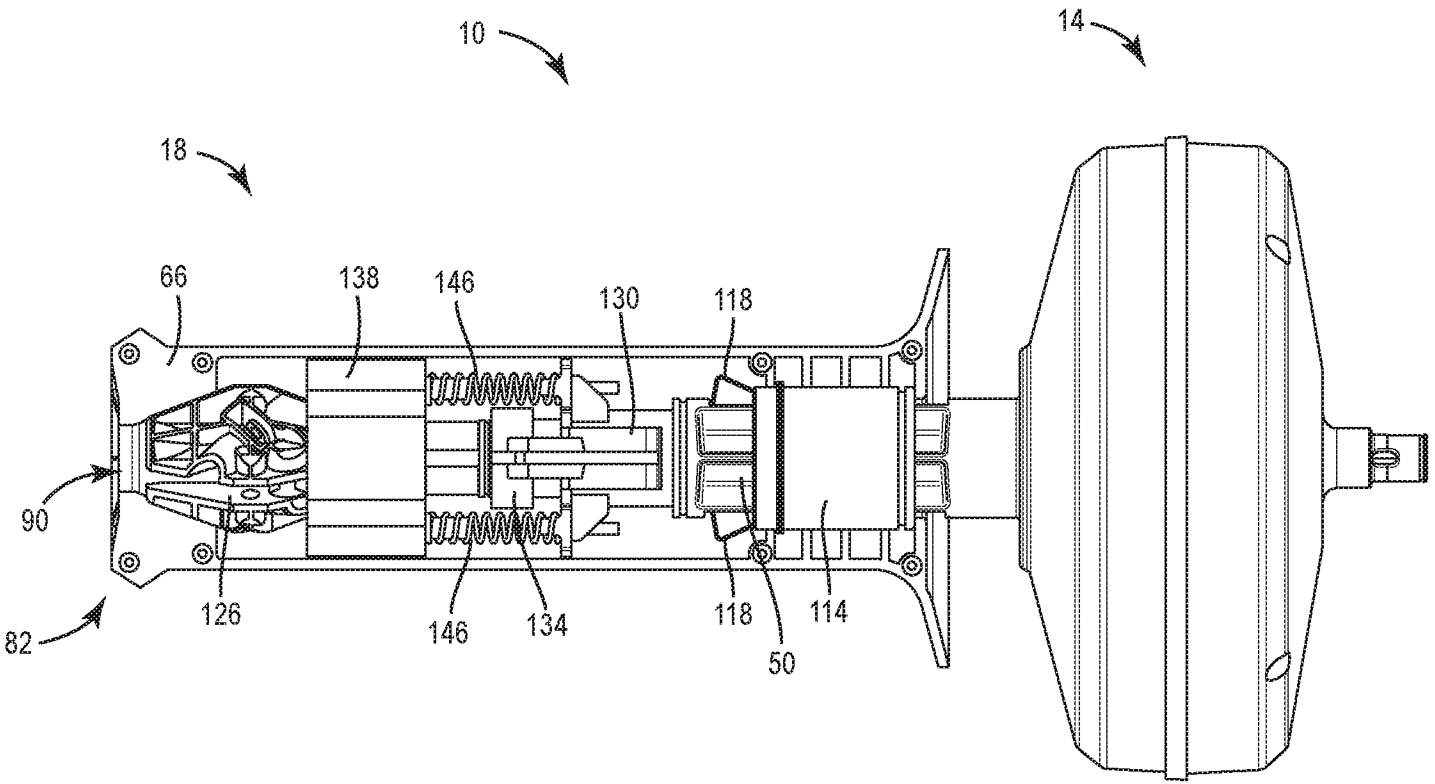
FIG. 6 is a side view of the drain cleaner of FIG. 4 with the portion of the handle removed while in a neutral position.

As shown in FIG. 6, in the neutral position, the cable clamps 118 are biased out of the openings 58 in the first portion 50 of the front housing portion 30. The collet 126 is partially positioned within the frustoconically-shaped opening 142 of the drive ramp 138 so that the inner surface 174 does not engage the cable. In the neutral position, the cable is free to spin by rotation of the drum assembly 14. In addition, a user may manually pull the cable out of the drain cleaner 10 and into a drain or conduit. The user may also manually push the cable back into the drum assembly 14. In other words, the cable is also free to translate out of or into the drain cleaner 10.

Figure 7:
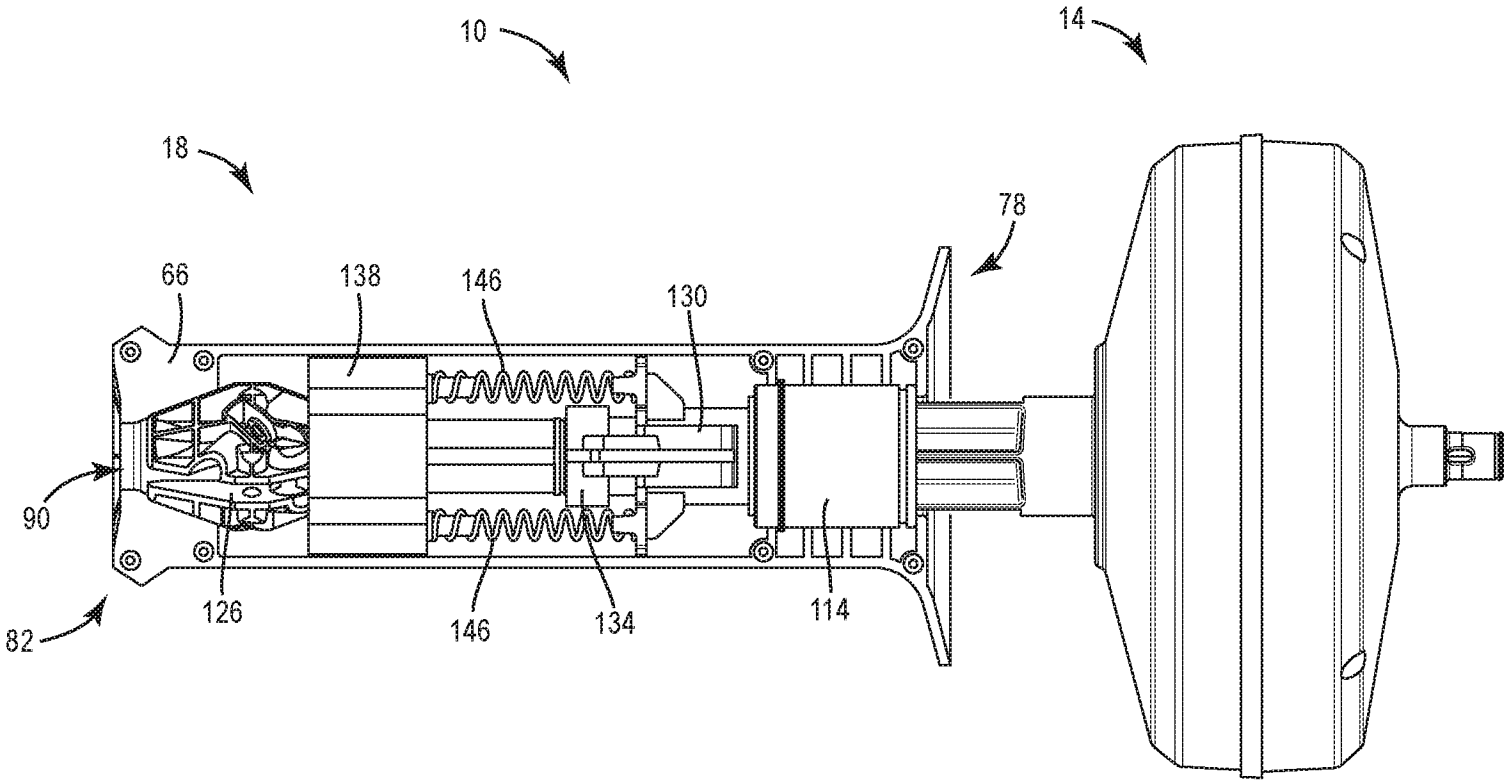
FIG. 7 is a side view of the drain cleaner of FIG. 4 with the portion of the handle removed while in a locked position.
Figure 8:
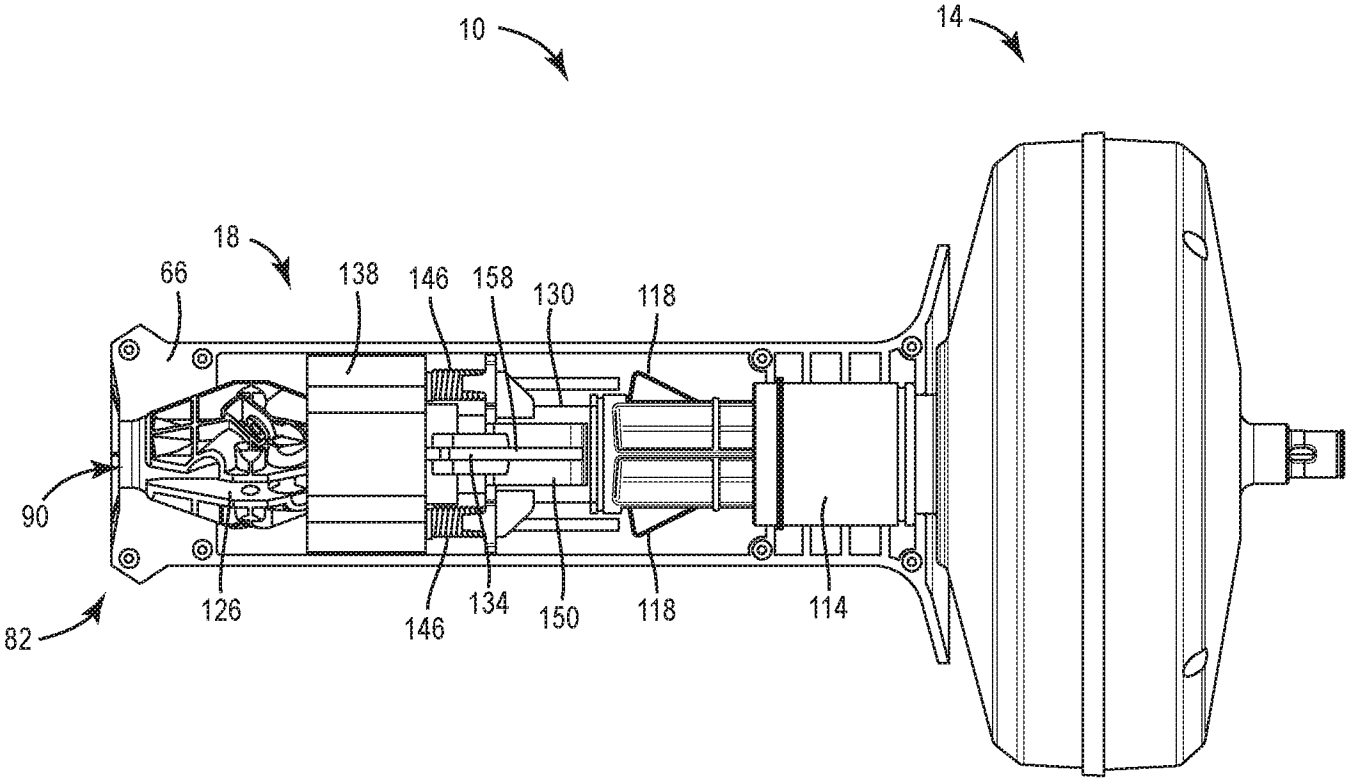
FIG. 8 is a side view of the drain cleaner of FIG. 4 with the portion of the handle removed while in an autofeed position.

As shown in FIG. 7, in the locked position, a user slides the handle 66 away from the drum assembly 14. In the illustrated embodiment, the handle 66 slides linearly (i.e., non-rotatably) away from the drum assembly 14 to move the actuator assembly 18 to the locked position. In other embodiments, the handle 66 may be rotated to move the actuator assembly to the locked position. Movement of the handle 66 away from the drum assembly 14 slides the actuator sleeve 114 over the cable clamps 118 (FIG. 6), causing the cable clamps 118 to move radially inwardly and engage the cable. In this position, the cable is clamped and, thereby, inhibited from translating out of the drain cleaner 10. The cable, however, is able to continue to spin about its longitudinal axis to break of debris within a drain.

As shown in FIG. 8, in the autofeed position, a user slides the handle 66 towards the drum assembly 14. As the handle 66 moves toward the drum assembly 14, the drive ramp 138 is forced towards the drive lock 130, which compresses the springs 146. Additionally, the collet 126 approaches the drive ramp 138, forcing the first end 162 of the collet 126 into the frustoconically-shaped opening 142 to compress the collet 126. As the collet 126 is compressed, the rollers of the collet 126 engage the flexible cable, which drives the flexible cable out of or into the outlet 90.

While in the autofeed position, a user can slide the handle 66 further towards the drum assembly 14. As the handle 66 moves closer to the drum assembly 14, the wings 150 of the drive lock 130 pass over the abutment 110 of the locking ramps 102. Once this occurs, when the user releases the handle 66, the wings 150 engage the abutment 110 of the locking ramps 102, inhibiting the handle 66 from sliding away from the drum assembly 14 (FIG. 9). As such, the handle is movable to a fourth position, which may also be referred to as an autofeed locked on position. In this position, when the user disengages the handle 66, the cable continues to spin and translate out of or into the drain cleaner 10.

In order to release the handle 66 from the autofeed locked on position, the user manually forces (e.g., slides) the handle 66 away from the drum assembly 14. This movement draws the drive lock 130 towards the lock release 134. The disengagement tabs 158 on the lock release 134 engage the wings 150 of the drive lock 130, forcing the wings 150 radially inwards against the bias of the compression springs 154 to clear the locking ramps 102 on the interior surface 98 of the handle 66. Once the wings 150 clear the locking ramps 102, the handle 66 is allowed to move relative to the drive lock 130. The compression springs 146 bias (e.g., push) the drive ramp 138 away from the drive lock 130. As the handle 66 is moved further away from the drum assembly 14, the collet 126 is released from the drive ramp 138, which disengages the rollers of the pieces of the collet 126 from the cable to stop driving the cable out of or into the drain cleaner 10.

In the illustrated embodiment, the autofeed locking mechanism 72 is used with a p-trap auger style machine. In other embodiments, the autofeed locking mechanism 72 may be used with other types of drain cleaners such as hand held drain cleaners, sewer cleaners, or the like.

Providing the drain cleaner 10 with the autofeed locking mechanism 72 allows a user to selectively control the output of a cable. In addition, the autofeed locked on position allows a user to disengage the handle 66 while still automatically driving the cable into or out of a drain.

Various features and advantages of the invention are set forth in the following claims.

What is claimed is:

1. A drain cleaner comprising:

a drum assembly configured to store a cable; and an actuator assembly movable relative to the drum assembly between a neutral position, where the cable is free to spin and translate out of the drum assembly, an autofeed position, where the cable is allowed to spin and is automatically driven out of the drum assembly, and an autofeed locked on position, where the actuator assembly is maintained in the autofeed position without continuous input from a user, the actuator assembly including a handle supported by the drum assembly and an autofeed locking mechanism, the autofeed locking mechanism includes a drive lock and a lock release, the drive lock engages the handle to maintain the actuator assembly in the autofeed locked on position;

wherein the handle includes an abutment on an interior surface, and wherein the drive lock includes a wing that engages the abutment to maintain the actuator assembly in the autofeed locked on position; and wherein the wing is biased radially outward to engage the abutment.

2. The drain cleaner of claim 1, wherein the actuator assembly is biased to the neutral position.

3. The drain cleaner of claim 1, wherein the drive lock is moveable relative to the drum assembly, and wherein the lock release is stationary relative to the drum assembly.

4. The drain cleaner of claim 1, wherein the actuator assembly moves linearly between the neutral position, the autofeed position, and the autofeed locked on position.

5. The drain cleaner of claim 1, wherein the actuator assembly is movable between the neutral position and the autofeed position in a direction towards the drum assembly.

6. The drain cleaner of claim 5, wherein the actuator assembly is moveable between the autofeed position and the autofeed locked on position in the direction towards the drum assembly.

7. The drain cleaner of claim 1, wherein the actuator assembly is movable between the autofeed locked on position and the autofeed position in a direction away from the drum assembly.

8. The drain cleaner of claim 1, wherein the actuator assembly is further movable to a locked position, where the cable is allowed to spin, but cannot move relative to the drum assembly.

9. The drain cleaner of claim 1, wherein the actuator assembly further includes a collet that engages the cable in the autofeed position to automatically drive the cable out of the drum assembly.

10. A drain cleaner comprising:

a drum assembly configured to store a cable, the drum assembly including a nose with a first portion and a second portion; and an actuator assembly movable relative to the drum, the actuator assembly including, a handle supported by the nose of the drum assembly, the handle including an inlet, an outlet opposite the inlet, a passage extending between the inlet and the outlet, and an abutment on an inside surface of the passage, a cable locking mechanism positioned within the handle, and an autofeed locking mechanism positioned within the handle, the autofeed locking mechanism including a drive lock positioned on the second portion of the nose and a lock release positioned on the second portion of the nose;

wherein the actuator assembly is moveable between a neutral position, where the cable is free to spin and translate out of the drum assembly, an autofeed position, where the cable is allowed to spin and is automatically driven out of or into the drum assembly, and a locked position, where the cable is able to spin, but not allowed to travel out of or into the drain cleaner; and wherein the drive lock engages the abutment of the handle to maintain the actuator assembly in the autofeed position;

wherein the drive lock is movable relative to the drum assembly, and wherein the lock release is stationary relative to the drum assembly; and wherein the drive lock includes a wing that is biased radially outwards to engage the abutment of the handle to maintain the actuator assembly in the autofeed position, and wherein the lock release includes a disengagement tab.

11. The drain cleaner of claim 10, wherein, when the actuator assembly is in the autofeed position, moving the actuator assembly away from the drum assembly slides the wing of the drive lock into engagement with the disengagement tab to disengage the wing from the abutment of the handle to release the actuator assembly from the autofeed position.

12. A drain cleaner comprising:

a drum assembly configured to store a cable; and an actuator assembly movable relative to the drum assembly between a neutral position, where the cable is free to spin and translate out of the drum assembly, an autofeed position, where the cable is allowed to spin and is automatically driven out of the drum assembly, and an autofeed locked on position, where the actuator assembly is maintained in the autofeed position without continuous input from a user, the actuator assembly including a handle supported by the drum assembly and an autofeed locking mechanism, the autofeed locking mechanism includes a drive lock and a lock release, the drive lock engages the handle to maintain the actuator assembly in the autofeed locked on position;

wherein the actuator assembly further includes a collet that engages the cable in the autofeed position to automatically drive the cable out of the drum assembly.

* * * * *